United States Patent [19]

Ionescu

[11] 4,222,399

[45] Sep. 16, 1980

[54] ARTIFICIAL NAIL

[76] Inventor: Miruleta Ionescu, 30-36 34th St., Astoria, Queens, N.Y. 11103

[21] Appl. No.: 834,519

[22] Filed: Sep. 19, 1977

[51] Int. Cl.[3] ..... A45D 29/00

[52] U.S. Cl. ..... 132/73

[58] Field of Search ..... 132/73, 88.7

[56] References Cited

U.S. PATENT DOCUMENTS

| | | | |
|---|---|---|---|
| 2,746,460 | 5/1956 | Jellinek | 132/73 |
| 3,478,756 | 11/1969 | Sautter et al. | 132/73 |
| 3,480,020 | 11/1969 | Ernest | 132/88.5 |
| 3,502,088 | 3/1970 | Jarby | 132/73 |

*Primary Examiner*—G. E. McNeill

*Attorney, Agent, or Firm*—Bertram Frank

[57] ABSTRACT

An artificial nail, e.g. an artificial toenail or fingernail, is built up on a flat flexible resilient arcuate form which is mounted on the actual human nail. The artificial nail is formed by depositing a layer of a mush of resin powder and a liquid solvent on the form while it is in place on the actual nail. Then the form is removed from the human nail and the mush layer is allowed to become almost dry, by permitting evaporation of the solvent until the mush layer is transformed into a soft cohesive layer. The cohesive layer, i.e. the artificial nail, is then peeled from the form and emplaced on the human nail by applying a layer of liquid nail glue to the human nail and depositing the cohesive layer on the glue layer. The cohesive layer thus becomes adhesively attached to the human nail and is permitted to dry into an artificial nail attached to the human nail. The artificial nail is then filed into a uniform extension of the human nail.

6 Claims, 11 Drawing Figures

FIG. 1
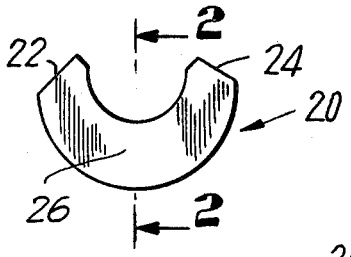
FIG. 2
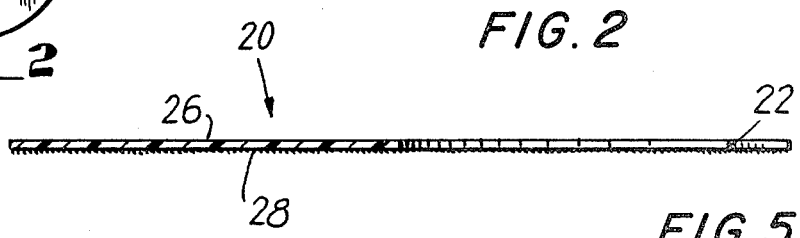
FIG. 3
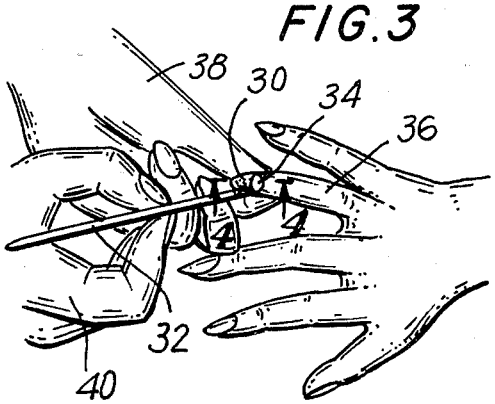
FIG. 5
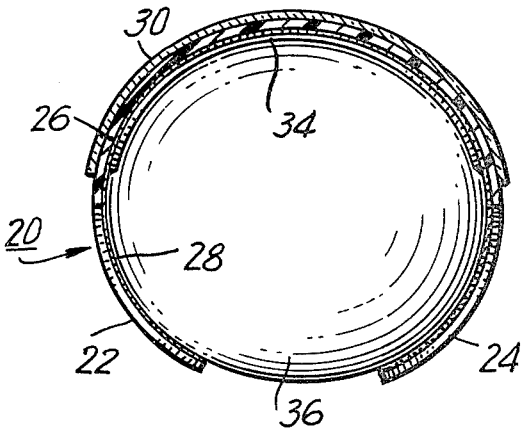
FIG. 4
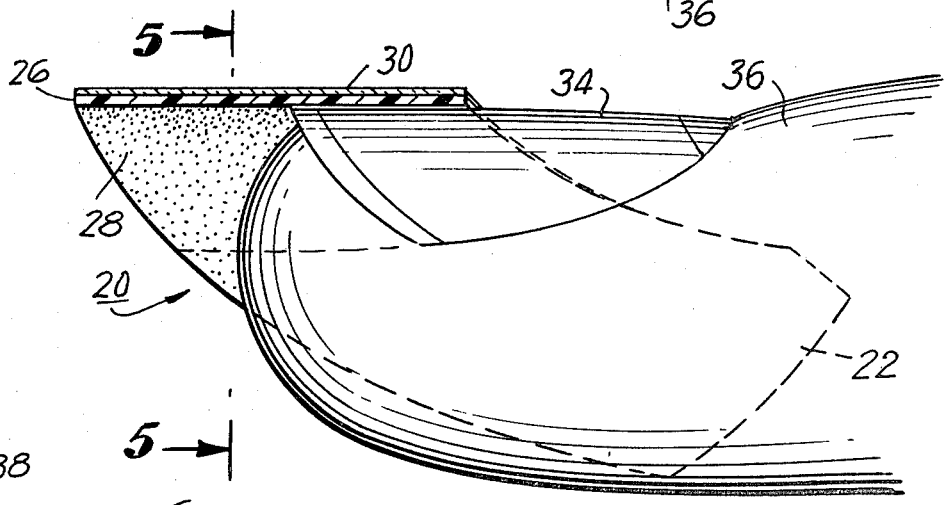
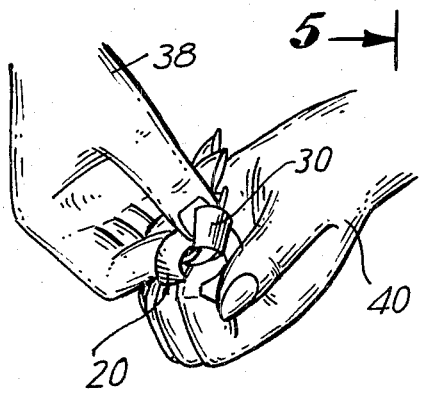
FIG. 6

ARTIFICIAL NAIL

BACKGROUND OF THE INVENTION

1. Field of the Invention

An improved artificial nail.

2. Description of the Prior Art

Artificial nails are deposited on human nails for various reasons and purposes. Perhaps the most important reason among women is to enhance the attractiveness of a human hand, by artificially lengthening the fingernails. Typically in this case the artificial nail is colored e.g. in one of various shades of red, orange or purple, in order to enhance the beauty and attractiveness of the subject's hand. Another reason for providing artifical nails is to protect the real human nail underneath the artificial nail, so that it may be allowed to grow into a strong healthy nail commensurate in size to the artificial nail. This is especially prevalent in instances where the person has a tendency to bite or gnaw away at his or her nails.

The prior art generally entails the building up of an artificial nail directly on the natural nail, using a mush or paste of any suitable material. When acrylic paste is used directly on the nail, and in all other methods now in existence such as sculptured nails, patty nails, ready-made plastic extensions covered with a coat of acrylic, etc., the natural nail underneath is damaged and weakened. In addition, further fillings or treatments are periodically required.

Pertinent prior art regarding artificial nails and their formation includes U.S. Pat. Nos. 3,478,756; 2,764,166 and 2,288,386.

SUMMARY OF THE INVENTION

1. Purposes of the Invention

It is an object of the present invention to provide an improved artificial nail.

Another object is to provide an improved method of depositing an artificial nail on a human nail using an improved form.

A further object is to form an artificial nail on a human nail using an improved form.

A further object is to form an artificial nail independently of the natural nail and subsequently to deposit it on the human nail.

An additional object is to provide an artificial nail which accurately simulates an actual human nail and seems to be part of the nail itself.

Still another object is to provide an artificial nail as an extension of a natural human nail.

Still a further object is to provide a method of depositing an artificial nail on a human nail which guarantees that there will be no damages to or weakening of the natural nail underneath the artificial nail.

Still a further object is to provide a method of depositing an artificial nail on a human nail in which once the artificial nail is applied, it requires no further fillings or treatment, just a regular manicure to clean up the cuticle.

A further object is to provide an artificial nail extension which grows together with the natural nail and is treated like a natural nail during the growing period of the nail itself, being readily filed and shortened when it is too long, until the nail underneath reaches the same length.

Still another object is to improve the appearance of human hands and/or feet by the provision of an improved artificial nail.

Another object is to allow damaged or weakened nails, especially those subject to nail biting or gnawing, to grow into strong healthy nails.

An object is to provide an artificial nail extension which gives a totally real appearance and cannot be distinguished from an actual natural human nail.

These and other objects and advantages of the present invention will become evident from the description which follows.

2. Brief Description of the Invention

In the present invention, an improved method of depositing an artificial nail on a human nail is provided which entails providing a flat flexible resilient arcuate transparent form of unique configuration. The form is composed of a layer of transparent scotch tape, i.e. a transparent layer of a tape composed of a limp transparent strip of mylar backed by a rubbery-base adhesive and a tackifier, bonded to a layer of transparent contact paper, i.e. a transparent layer of paper or paper-like material which has previously had a layer of backing material detachably bonded to it by an adhesive.

The form is fitted to a human nail as a uniform extension thereof by virtue of the arcuate configuration of the form. Specifically, the form is fitted to a human nail with the layer of contact paper in contact with the human nail. A mush or paste of resin powder and a liquid solvent therefor is formed. The mush is spread as a layer on top of the scotch tape layer of the form, so that the mush is deposited as a mush layer in the form of an extension of the human nail. Then the form is removed from the human nail. The mush layer is then allowed to become almost dry, by permitting evaporation of the solvent until the mush layer is transformed into a soft cohesive layer. Then the soft cohesive layer is peeled from the form. A layer of liquid nail glue is then applied to the human nail. The cohesive layer is deposited on the glue layer, so that the cohesive layer becomes adhesively attached to the human nail. Then the cohesive layer is permitted to fully dry into an artificial nail. Finally the artificial nail is filed into a uniform extension of the human nail.

Any suitable resin powder may be employed; typically, the resin powder is the powder of a resin selected from the group consisting of an acrylic resin, polyvinyl acetate, a polyester, an aryl sulfonamide, ethyl cellulose, cellulose acetate butyrate, cellulose acetate, polyvinyl butyral, polyvinyl formal, methyl methacrylate, dammar, mastic, sandarac, benzoin and rosin (colophony). Any suitable solvent for the resin powder may be employed; typically, the solvent is selected from the group of resin powder solvents consisting of acetone, acetic acid, ethyl acetate, dioxane, pyridine, ethanol, tetrachloroethane, trichloroethane and toluol. Any suitable type of nail glue may be employed; a typical nail glue feasible for usage in the present invention is a liquid formulation containing cyanoacrylate. A layer of the nail glue may be deposited on the artificial nail, after the artificial nail is filed to conform to the shape of the human nail as a uniform extension thereof.

The present invention includes the form as described supra; this form is preferably prepared by depositing scotch tape on the side of a section of contact paper opposite to the backing side, cutting the composite element thus formed into an arcuate shape using a scissors or the like, and peeling off the contact paper backing.

The present artificial nail provides several salient advantages. The present artificial nail is deposited on a human nail by method and using a form which does not damage or weaken the natural human nail beneath the artificial nail. The present artificial nail accurately simulates an actual human nail and seems to be part of the nail itself. The present artificial nail, when once applied, requires no further fillings, addition or treatment, just a regular manicure to clean up the cuticle. The artificial nail extension grows together with the natural nail and is treated like a natural nail during the growing period of the nail itself, being readily filed and shortened when it is too long, until the nail underneath reaches the same length. The appearance of human hands and/or feet is improved and enhanced by the present artificial nail. Damaged or weakened nails may be allowed and permitted to grow into strong healthy nails, especially in the case of those who bite or gnaw on their nails. The present artificial nail extension gives a totally real appearance and cannot be distinguished from the actual natural human nail. The use of the present form eliminates the objectionable features of prior art methods in which the artificial nail is built up directly on the human nail. Thus an improved method of depositing an artificial nail on a human nail using an improved form has been provided.

The invention accordingly consists in the features of construction, combination of elements, arrangement of parts and series of steps which will be exemplified in the method and article hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a plan view of the present form;

FIG. 2 is a sectional elevation view taken substantially along the line 2—2 of FIG. 1;

FIG. 3 shows the application of the mush or paste to the form with the form in place on a human nail;

FIG. 4 is a sectional elevation view taken substantially along the line 4—4 of FIG. 3;

FIG. 5 is a sectional elevation view taken substantially along the line 5—5 of FIG. 4;

FIG. 6 shows the manipulative peeling of the soft cohesive layer of partially dried mush from the form;

DETAILED DESCRIPTION OF THE PREFERRED EMBODIMENTS

Figure 8:
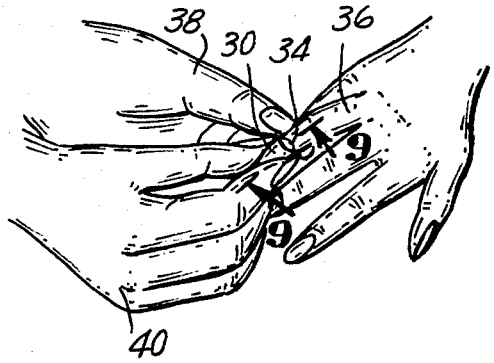
FIG. 8 shows the manipulative mode of emplacement of the cohesive layer on the human nail.

Referring now to FIGS. 1 and 2, the present form 20 is of a generally arcuate or curved configuration in the form of a C-shape, and generally the ends 22 and 24 of the form have straight line edges. The form 20 is characterized by an upper layer 26 of scotch tape bonded to a lower layer 28 of contact paper, and form 20 has been fabricated and assembled as described supra.

FIGS. 3,4 and 5 show the steps of applying a mush or paste layer 30 of resin powder and a liquid solvent to the form 20 using a brush 32, with the form 20 in place on an actual natural human nail 34 of a finger 36. The hand 38 of a beautician or other operator holds the form 20 in place on the human nail 34 as shown in FIGS. 4 and 5, by pressing the ends 22 and 24 of the form 20 against the sides of the finger 36 adjacent the nail 34 with the ends 22 and 24 laterally depending from the nail 34. The form 20 forms a uniform extension of the human nail 34, as best seen in FIG. 4. The other hand 40 of the beautician or other operator manipulates the brush 32 laden with the mush or paste, so as to deposit the layer 30 which, after the form 20 is removed from juxtaposition with the nail 34, is allowed to partially dry into a soft cohesive layer. As best seen in FIGS. 4 and 5, the layer 30 is entirely deposited on the upper layer 26 of the form 20.

FIG. 6 shows the operator manually peeling the almost dry layer 30, which is now an artificial nail, from the form 20. The artificial nail 30 at this stage is basically a partially dried soft cohesive layer of material.

Figure 7:
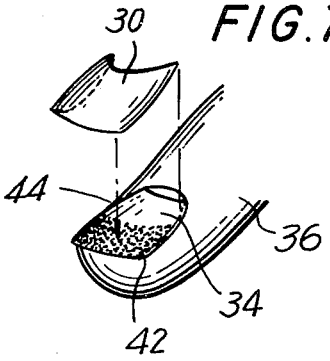
FIG. 7 shows the orientation of emplacement of the cohesive layer to the natural human nail.
Figure 9:
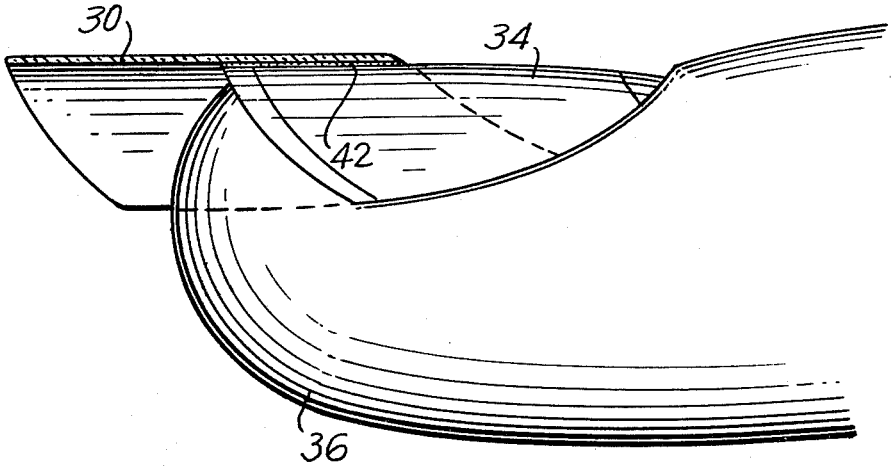
FIG. 9 is a sectional elevation view of the artificial nail in place on the human nail.
Figure 10:
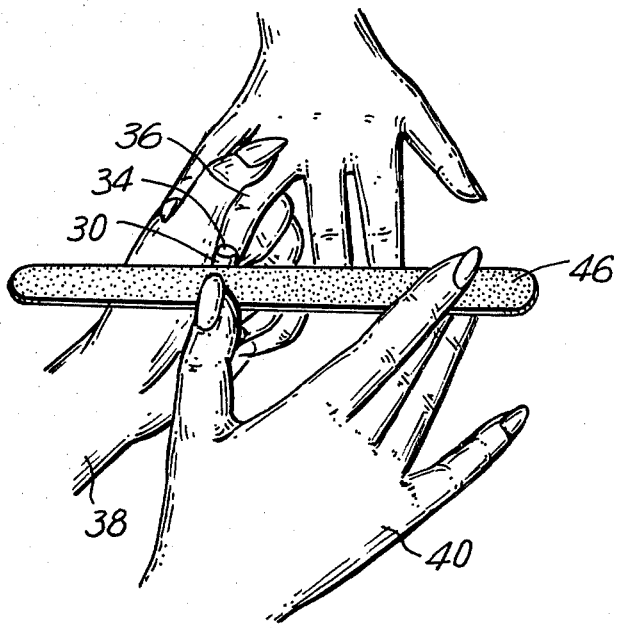
FIG. 10 shows the filing of the artificial nail to complete the simulation of the artificial nail as a uniform extension of the human nail.
Figure 11:
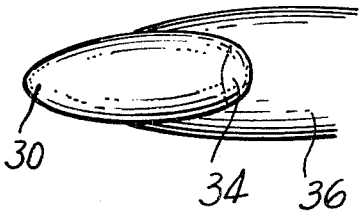
FIG. 11 shows the final nail with the artificial nail in place and part of the actual natural human nail.

FIGS. 7 and 8 illustrate later stages of the method. A layer 42 of nail glue has been deposited on the human nail 34 as a coating by a procedure similar to that illustrated in FIG. 3. The artificial nail 30 is emplaced downwards as indicated by arrow 44 so that the artificial nail 30 is adhesively bonded to the human nail 34 as a uniform extension thereof, as best seen in FIG. 9. The artificial nail is now allowed to fully dry and harden in situ on the nail 34. The final stage of the method as shown in FIG. 10 entails the filing of the artificial nail 30 by the operator using nail file 46 which is any suitable filing means and generally consists, as shown, of a strip of wood coated with a suitable abrasive. In other instances a metal strip file may be employed. The final nail as shown in FIG. 11 is a uniform nail in which the artificial portion 30 is indistinguishable from the natural portion 34.

It thus will be seen that there is provided a method and form for artificial nails which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A method of forming an artificial nail on a human nail, comprising the steps of positioning a yieldable flat form on a human nail so that a portion of said form conformingly covers a surface zone of said human nail; forming a layer of hardinable artificial nail material only on said form so as to have the same outline as said surface zone; removing said form, together with said layer formed thereon, from said human nail; allowing said layer to partially harden on said form into a cohesive layer having the same outline on said portion as said surface zone; separating said partially hardened cohesive layer from said form, adhering said cohesive layer to said surface zone in conformity with the outlines and shape thereof; and permitting said cohesive layer to completely harden into an artificial nail which fully covers said surface zone and is curved in conformity therewith.

2. The method of claim 1, wherein said forming step includes spreading a mush including a powder of a resin selected from the group consisting of an acrylic resin, polyvinyl acetate, a polyester, an aryl sulfonamide, ethyl cellulose, cellulose acetate butyrate, cellulose acetate, polyvinyl butyral, polyvinyl formal, methyl methacrylate, dammar, mastic, sandarac, benzoin and rosin (colophony) and a liquid solvent over said form.

3. The method of claim 2, wherein said forming step includes spreading a mush including a resin powder and a liquid solvent selected from the group consisting of acetone, acetic acid, ethyl acetate, dioxane, pyridine, ethanol, tetrachloroethane, trichloroethane and toluol over said form.

4. The method of claim 1, wherein one of said positioning steps includes so placing said form on said human nail that another portion of said form extends beyond said human nail in the direction of the growth of the latter; and wherein said forming step includes extending said layer beyond said portion to provide said artificial nail with an integral extension projecting beyond said human nail in said direction.

5. The method of claim 1, wherein said adhering step includes using a nail glue containing cyanoacrylate.

6. The method of claim 4; further comprising the step of filing the said extension to the desired shape following said hardening step.

* * * * *